United States Patent [19]

Hardy

[11] Patent Number: 4,503,701

[45] Date of Patent: Mar. 12, 1985

[54] PANEL STRAIGHTENING APPARATUS AND METHOD

[76] Inventor: Michael J. Hardy, 5524 W. Sioux Trail, Peoria, Ill. 61607

[21] Appl. No.: 532,466

[22] Filed: Sep. 15, 1983

[51] Int. Cl.[3] ..... B21D 1/12

[52] U.S. Cl. ..... 72/372; 72/325; 72/458; 72/479; 72/705

[58] Field of Search ..... 72/705, 458, 479, 325, 72/372; 294/15, 17, 26; 30/366, 443, 367; 254/131, 131.5; 29/402.19, 402.21

[56] References Cited

U.S. PATENT DOCUMENTS

| | | | |
|---|---|---|---|
| 1,425,704 | 8/1922 | Shek | 30/443 |
| 1,737,084 | 11/1929 | Hilstad | 72/705 |
| 2,191,720 | 2/1940 | Meinhardt | 72/705 |
| 2,852,971 | 9/1958 | Macaluso, Jr. | 72/705 |
| 2,900,853 | 8/1959 | Steck | 72/457 |
| 2,949,144 | 8/1960 | Dredske et al. | 72/705 |
| 3,100,336 | 8/1963 | Fannin | 72/458 |
| 4,316,326 | 2/1982 | Yeaton et al. | 30/366 |
| 4,404,749 | 9/1983 | Emerson | 30/164.9 |

FOREIGN PATENT DOCUMENTS

| | | | |
|---|---|---|---|
| 710438 | 6/1954 | Canada | 72/705 |

*Primary Examiner*—Lowell A. Larson
*Attorney, Agent, or Firm*—James R. Bell

[57] ABSTRACT

A panel straightening apparatus includes a first dent engaging member having a pointed-tip spike portion to be driven through the dent in an automotive body panel. A second leverage member is then engaged with the first member and leverage is applied to move the dented area into substantial alignment with the panel surface. The second member includes a lever arm curved to permit engagement with the first member at various heights above the panel. The first member includes a handhold for use without the lever arm.

6 Claims, 9 Drawing Figures

PANEL STRAIGHTENING APPARATUS AND METHOD

BACKGROUND OF THE INVENTION

1. Field of the Invention

This invention relates generally to metal deforming and more particularly to a metal deforming apparatus and method for repairing dents in automobile body panels.

2. Description of the Prior Art

The automobile body repairing art requires the use of certain devices to straighten dents in auto body panels. These devices are usually leverage type devices. Ordinarily a hole is drilled into the dented area of the panel. A first tool is commonly threaded into the hole. A leverage member is then engaged with the first tool and leverage is applied to move the dented area substantially into alignment with the original panel surface.

Another such device is not threaded but also requires a hole to be drilled into the dented area. The tool is inserted through the hole and an angled portion of the tool engages the underside of the dented area. A leverage member is then engaged with the inserted tool and leverage is applied to substantially straighten the dent.

Both of the above-described devices are limited in that they require a hole to be drilled in the panel. Also, a limitation of the threaded tool is that the force of the leverage member can damage the threads.

The foregoing illustrates limitations of the known prior art. Thus, it is apparent that it would be advantageous to provide an alternative directed to overcoming one or more of the limitations as set forth above. Accordingly, a suitable alternative is provided including features more fully disclosed hereinafter.

SUMMARY OF THE INVENTION

In one aspect of the present invention, this is accomplished by providing a panel straightening apparatus including a first member having a spike portion and an attachment portion. The attachment portion includes a handfold and a lever receiving aperture formed therein. The spike portion has a substantially pointed tip and is bent at about 90 degrees relative to the attachment portion.

A second member is engaged with the first member and has a lever portion pivotally attached to a base portion.

The foregoing and other aspects will become apparent from the following detailed description of the invention when considered in conjunction with the accompanying drawing. It is to be expressly understood, however, that the drawing is not intended as a definition of the invention but is for the purpose of illustration only.

BRIEF DESCRIPTION OF THE DRAWING

In the drawing:

FIG. 4*b* is a view illustrating an embodiment of a replacement tip for the tool of FIG. 4*a.

DESCRIPTION OF THE PREFERRED EMBODIMENT

Figure 1:
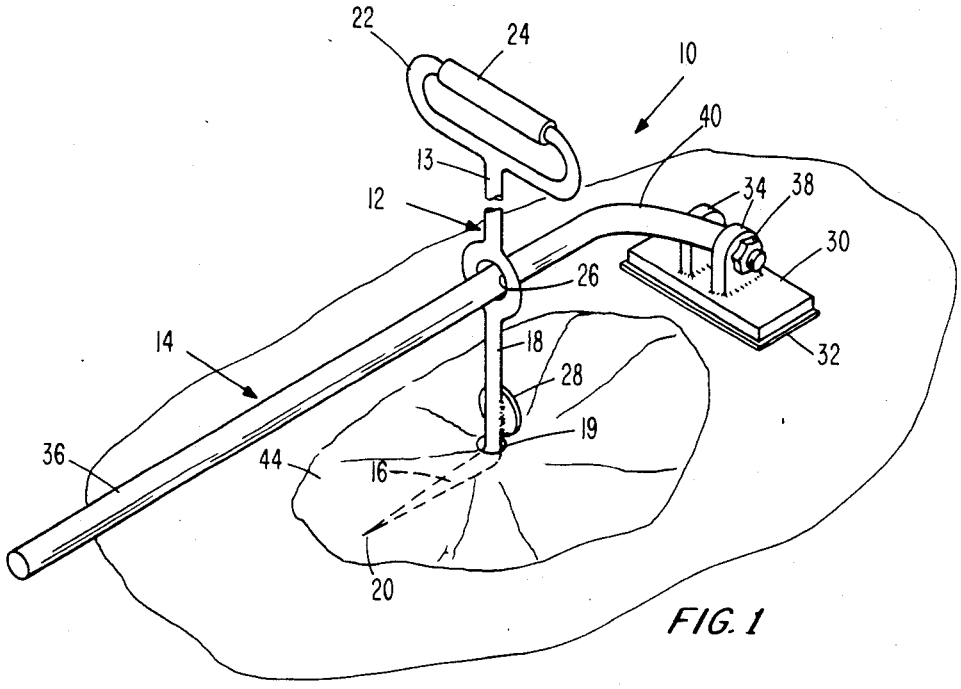
FIG. 1 is a perspective view illustrating an embodiment of the apparatus of this invention.
Figure 2A:
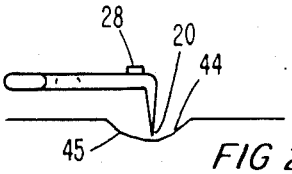
FIG. 2*a* is a view diagrammatically illustrating an embodiment of a first member of this invention.
Figure 2B:
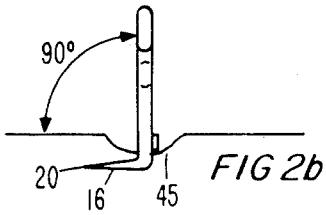
FIG. 2*b* is another view diagrammatically illustrating an embodiment of the first member of this invention.

Referring now to the drawings, FIG. 1 illustrates a panel straightening apparatus generally designated 10 and including a first member 12 and a second member 14. First member 12 is preferably formed of a suitable steel and includes a hardened spike portion 16 bent at about 90 degrees relative to an attachment portion 18. Spike portion 16 tapers to a substantially pointed tip 20. Attachment portion 18 includes a handhold 22 having a suitable padded grip 24 and also includes at least one lever receiving aperture 26 formed therethrough. An impact pad 28 is attached, by welding or the like, to attachment portion 18 at bend 19 immediately adjacent spike portion 16. An elongated shaft 13 interconnects handhold 22 and aperture 26.

Figure 3A:
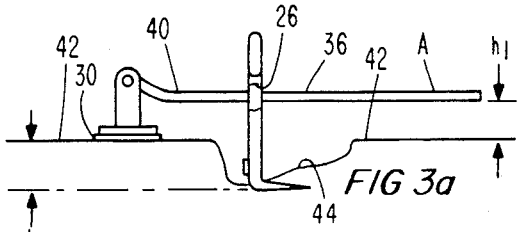
FIG. 3*a* is a view diagrammatically illustrating an embodiment of the apparatus of this invention including a lever at a first height above a dented panel.
Figure 3B:
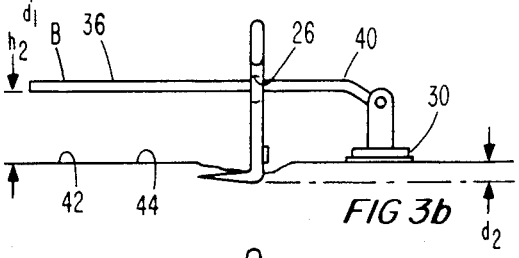
FIG. 3*b* is another view diagrammatically illustrating an embodiment of the apparatus of this invention including the lever at a second height above the panel.
Figure 3C:
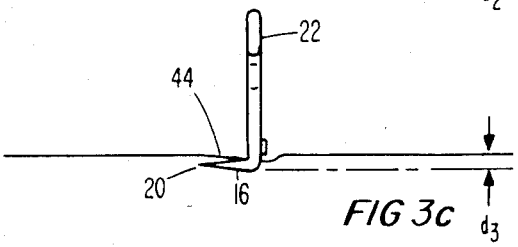
FIG. 3*c* is a further view diagrammatically illustrating an embodiment of the first member of this invention.

Second member 14 is also of a suitable steel and includes a base portion 30 having a suitable resilient pad 32 attached thereto. A pair of spaced flanges 34 receive a lever portion 36 therebetween. A bolt 38, or the like, pivotally connects lever portion 36 with base portion 30. Lever portion 36 includes a bend 40 immediately adjacent the pivotal connection at bolt 38. Bend 40 is of a construction sufficient to position lever 36 in a first position A at a first height $h_1$, above and substantially parallel to a panel surface 42 as illustrated in FIG. 3*a*. Pivotal movement of lever 36, about 180 degrees, to a second position B, positions lever 36 at a second height $h_2$, above and substantially parallel to panel surface 42, see FIG. 3*b*, where $h_2$ is greater than $h_1$. Lever 36 is slidably received in aperture 26.

Figure 4A:
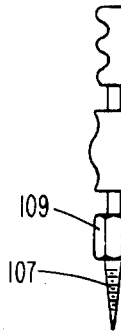
FIG. 4*a* is a view of an existing tool.
Figure 4B:
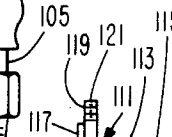
Figure 4C:
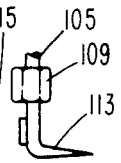
* and FIG. 4*c* is a view illustrating the tip of FIG. 4*b* attached to the tool of FIG. 4*a*.

A well-known existing tool, 101 (FIG. 4*a*) similar to first member 12, includes a slide hammer 103 which is slidably mounted on elongated shaft portion 105. The slide hammer is used to apply impact forces to tool 101 which aids in working a dented area out of a panel surface. Thus, if desired, a slide hammer can be added to elongated shaft portion 13 of first member 12. This existing tool is of the type previously discussed which utilizes a threaded tip 107. Since the threaded tip 107 often wears out and must be replaced, it is attached to the existing tool 101 via a nut 109. The present invention contemplates providing an "L" shaped tool portion 111, as shown in FIG. 4*b*, having a hardened spike portion 113 at a first end 115, an impact pad 117, and a threaded shaft portion 119 at a second end 121 to mate with the threads of the nut 109 in the existing tool 101. In this manner, the "L" shaped tool portion 111, can be attached to the existing tool 101 to replace the worn out threaded tip 107 as illustrated in FIG. 4*c*.

Materials, other than those specified may be found to be suitable. Also, if desired, a plurality of lever receiving apertures 26 can be formed in attachment portion 18 to provide various slidable connections for receiving lever portion 36.

In operation, the apparatus 10 is utilized in a method of straightening a dented area 44 in a panel surface 42.

Pointed tip 20 is located in the approximate center of dented area 44 as illustrated in FIG. *2a*. A commonly available tool, such as a hammer or the like, (not shown) is used to impact pad 28 and drive spike portion 16 through dented area 44. Member 12 is rotated at about 90 degrees until the centroidal axis of attachment portion 18 is substantially perpendicular to panel surface 46 and the centroidal axis of spike portion 16 is substantially parallel to underside 45 of dented area 44, see FIG. *2b*.

Dented area 44 is initially at a first depth $d_1$, see FIG. *3a*, relative to surface 42. Lever 36 is moved to first position A, at first height $h_1$ and is inserted through aperture 26. A force is applied to first member 12 via lever 36 and directed away from surface 46 as indicated by a directional arrow designated 60. As a result, dented area 44 is moved toward alignment with surface 42 to a second depth $d_2$ less than $d_1$.

Base 30 is relocated to permit lever 36 to be pivoted to position B at second height $h_2$ and is inserted through aperture 26, see FIG. *3b*. Again, a force applied to member 12 via lever 36 moves dented area 44 toward alignment with surface 42 to a third depth $d_3$, less than $d_2$.

Second member 14 is removed, see FIG. *3c*, and a force is applied directly to first member 12, via handhold 22, moving dented area 44 still further toward alignment with surface 42.

It is to be understood that, depending on the initial depth of dented area 44 and the force required to move dented area 44 into alignment with surface 42, lever 36 can be used at anytime in either of positions A or B, or, first member 12 may be used at anytime without applying force through lever 36.

The foregoing has described a panel straightening apparatus including a first dent engaging member having a pointed-tip spike portion to be driven through the dent in an automotive body panel. A second leverage member is then engaged with the first member and leverage is applied to move the dented area into substantial alignment with the panel surface. The second member includes a lever arm curved to permit engagement with the first member at various heights above the panel. The first member includes a handhold for use without the lever arm.

It is anticipated that aspects of the present invention, other than those specifically defined in the appended claims, can be obtained from the foregoing description and the drawings.

Having thus described the invention, what is claimed is:

1. A method of straightening a dented area in a panel surface utilizing a panel straightening apparatus having a first member and a second member, including the steps of:

(a) driving a substantially pointed spike portion of said first member into said dent by impacting an impact pad attached immediately adjacent said spike portion, said spike portion being bent at about 90 degrees relative to an attachment portion of said first member;

(b) rotating said first member to position wherein said spike portion is substantially parallel to the underside of said dented area;

(c) locating a padded base portion of said second member on said panel adjacent said dent;

(d) moving a lever portion of said second member to a first position at a first height above said panel and engaging said lever through a lever receiving aperture formed in said attachment portion, said lever portion being pivotally connected to said base portion; and (e) applying a force to said lever, said force being directed away from said panel and being sufficient to move said dent toward alignment with said panel surface.

2. The method of claim 1 including the further step of:

(a) relocating said padded base portion to a position sufficient to permit said lever to be pivoted to a second position wherein said lever engages said attachment portion at a second height above said panel, relatively higher than said first height; and (b) again applying a force to said lever directed away from said panel for moving said dent further toward alignment with said panel surface.

3. The method of claim 2 including the still further step of:

(a) removing said second member; and (b) gripping a handhold on said first member and applying a force thereto directed away from said panel for moving said dent still further toward alignment with said panel surface.

4. The method of claim 2 wherein said second position is about 180 degrees from said first position.

5. The method of claim 1 wherein said lever portion is substantially curved immediately adjacent said pivotal connection to said padded base portion.

6. The method of claim 5 wherein said lever portion is slidably engaged with said lever receiving aperture.

* * * * *

UNITED STATES PATENT AND TRADEMARK OFFICE

CERTIFICATE OF CORRECTION

PATENT NO. : 4,503,701

DATED : March 12, 1985

INVENTOR(S) : Michael J. Hardy

It is certified that error appears in the above-identified patent and that said Letters Patent is hereby corrected as shown below:

Col. 1, line 44, change "handfold" to --handhold--.

Signed and Sealed this

*Twenty-third* Day of *July 1985*

[SEAL]

*Attest:*

DONALD J. QUIGG

*Attesting Officer* *Acting Commissioner of Patents and Trademarks*